US010606199B1

(12) United States Patent
Antonio

(10) Patent No.: US 10,606,199 B1
(45) Date of Patent: Mar. 31, 2020

(54) SYSTEM AND METHOD FOR CONTROLLING A POWER SUPPLY IN AN IMAGE FORMING DEVICE

(71) Applicant: Lexmark International, Inc., Lexington, KY (US)

(72) Inventor: Don Dexter A. Antonio, Consolacion (PH)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/135,776

(22) Filed: Sep. 19, 2018

(51) Int. Cl.
*G03G 15/00* (2006.01)
*G03G 21/18* (2006.01)

(52) U.S. Cl.
CPC ..... *G03G 15/5004* (2013.01); *G03G 21/1892* (2013.01)

(58) Field of Classification Search
CPC ..... G03G 15/5004; G03G 15/55; G03G 21/1892; G03G 21/1875
USPC ..... 399/12, 25, 31
See application file for complete search history.

(56) References Cited

U.S. PATENT DOCUMENTS 8,290,389 B2 * 10/2012 Furubayashi ..... G03G 21/1867 399/111
2007/0297815 A1 * 12/2007 Takada ..... G03G 15/0863 399/12
2010/0290791 A1 * 11/2010 Sonoda ..... G03G 15/55 399/12
2013/0089343 A1 * 4/2013 Nishimura ..... G03G 15/0863 399/12
2018/0039198 A1 * 2/2018 Saito ..... G03G 15/0121
2018/0046137 A1 * 2/2018 Ajima ..... G03G 15/0863

FOREIGN PATENT DOCUMENTS

JP 2005326736 A * 11/2005 ..... G03G 15/50
JP 2006204034 A * 8/2006
JP 2009139874 A * 6/2009
JP 2012233988 A * 11/2012
JP 2013076810 A * 4/2013 ..... G03G 15/502
JP 2013097289 A * 5/2013

* cited by examiner

*Primary Examiner* — Robert B Beatty

(57) ABSTRACT

An image forming device includes a controller and a power supply unit in communication with the controller. The power supply unit includes a voltage converter for supplying voltage to a component of the image forming device. A memory unit on the voltage converter stores characterization data specific to the voltage converter having been characterized during production of the power supply unit and defining a predefined voltage response characteristic of the voltage converter. The controller is configured to selectively adjust a voltage response of the voltage converter to deviate away from the predefined voltage response characteristic based on a detected error condition relating to a replaceable unit installed in the image forming device. When the error condition has been corrected, the controller is configured to adjust the voltage response of the voltage converter to the predefined voltage response characteristic.

2 Claims, 4 Drawing Sheets

SYSTEM AND METHOD FOR CONTROLLING A POWER SUPPLY IN AN IMAGE FORMING DEVICE

CROSS REFERENCES TO RELATED APPLICATIONS

None.

BACKGROUND

1. Field of the Disclosure

The present disclosure relates to image forming devices and more particularly to systems and methods for controlling a power supply in an image forming device to provide improved security.

2. Description of the Related Art

In some imaging devices, electronic authentication schemes associated with consumable supply items are used to provide security. Consumable supply items may contain an integrated circuit chip or security device that communicates with a controller located in the imaging device. In such an arrangement, the controller may check the authenticity of the consumable supply item by sending a verification challenge thereto and determining if the consumable item correctly responds to the verification challenge. The authenticity is verified by the controller receiving from the supply item the correct response to the challenge. Otherwise, if the supply item does not respond correctly, the supply item may be detected as a clone or counterfeit, and appropriate actions may be taken to protect against the use of unauthorized supply items in order to optimize performance of and/or prevent damage to the imaging device. However, the security of such authentication schemes may be vulnerable to hacking. For example, hacking may expose security of the authentication schemes and allow unauthorized manufacturers to develop counterfeit supply items that could bypass and/or override authentication procedures, which may then allow the counterfeit supply items to still operate when installed in the imaging device. Accordingly, other means to improve security and protect against counterfeit supplies are desired.

SUMMARY

Embodiments of the present disclosure provide features that improve security in an image forming device by selectively altering power supply parameters based on a status and/or condition of an installed supply device in a manner that encourages users to discontinue using unauthorized replacements to prevent damage to the image forming device.

In one example embodiment, a method of controlling a power supply in an image forming device includes detecting, by the image forming device, an error condition relating to a replaceable unit installed in the image forming device. Detecting the error condition may include determining whether the replaceable unit is a valid component for use in the image forming device. In response to detecting the error condition, a voltage response of a voltage converter of the power supply is altered to deviate away from a predefined voltage response characteristic of the voltage converter. The voltage response of the voltage converter may be defined based at least in part by a resistance value of a programmable resistive component of the voltage converter. In one example aspect, the programmable resistive component may include a digital rheostat and altering the voltage response may include adjusting a wiper setting of the digital rheostat. Adjusting the wiper setting may include modifying the wiper setting to one of a random wiper position value and a predetermined wiper position value.

The method further includes determining, by the image forming device, whether the error condition has been corrected. Determining whether the error condition has been corrected may include determining whether a valid replaceable unit has been installed in the image forming device following removal of the replaceable unit from the image forming device. In response to determining that the error condition has been corrected, the voltage response of the voltage converter is adjusted to correspond to the predefined voltage response characteristic. Adjusting the voltage response to correspond to the predefined voltage response characteristic may include adjusting a wiper setting of the digital rheostat of the voltage converter to a predetermined default wiper setting. The predetermined default wiper setting may be determined during production of the power supply.

A power supply unit for an image forming device according to another example embodiment includes a voltage converter for supplying voltage to a component of the image forming device when the power supply unit is installed in the image forming device. The voltage converter has a voltage response defining a manner in which the voltage converter supplies voltage to the component. The power supply also includes a memory unit storing characterization data defining a predefined voltage response characteristic of the voltage converter. When the power supply unit is installed in the image forming device, the power supply unit is configured to modify the voltage response of the voltage converter to deviate away from the predefined voltage response characteristic in response to the image forming device detecting an error condition relating to a replaceable unit installed in the image forming device. The voltage converter includes a programmable resistive component and the voltage response is defined at least in part by a resistance value of the programmable resistive component. In one example aspect, the programmable resistive component may include a digital rheostat. The programmable resistive component has a default wiper position characterized during production, the default wiper position setting the voltage response of the voltage converter to the predefined voltage response characteristic. The power supply unit is configured to change a wiper setting of the programmable resistive component to a value different from the default wiper position to deviate the voltage response of the voltage converter away from the predefined voltage response characteristic. In response to the image forming device determining that the error condition has been corrected, the power supply unit is configured to restore the voltage response of the voltage converter to the predefined voltage response characteristic.

An image forming device according to another example embodiment includes a controller and a power supply unit in communication with the controller. The power supply unit includes a voltage converter for supplying voltage to a component of the image forming device. A memory unit on the voltage converter stores characterization data specific to the voltage converter having been characterized during production of the power supply and defining a predefined voltage response characteristic of the voltage converter. The controller is configured to selectively adjust a voltage response of the voltage converter to deviate away from the predefined voltage response characteristic based on a detected error condition relating to a replaceable unit installed in the image forming device. The voltage converter includes a programmable resistive component having a default resistance value defining at least in part the predefined voltage response characteristic of the voltage converter. To deviate the voltage response of the voltage converter away from the predefined voltage response characteristic, the controller is configured to adjust a resistance value of the programmable resistive component to a value different from the default resistance value. In response to determining that the error condition has been corrected, the controller is configured to adjust the voltage response of the voltage converter to the predefined voltage response characteristic.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify variations. Portions and features of some embodiments may be included in or substituted for those of others. The following description, therefore, is not to be taken in a limiting sense and the scope of the present disclosure is defined only by the appended claims and their equivalents.

Figure 1:
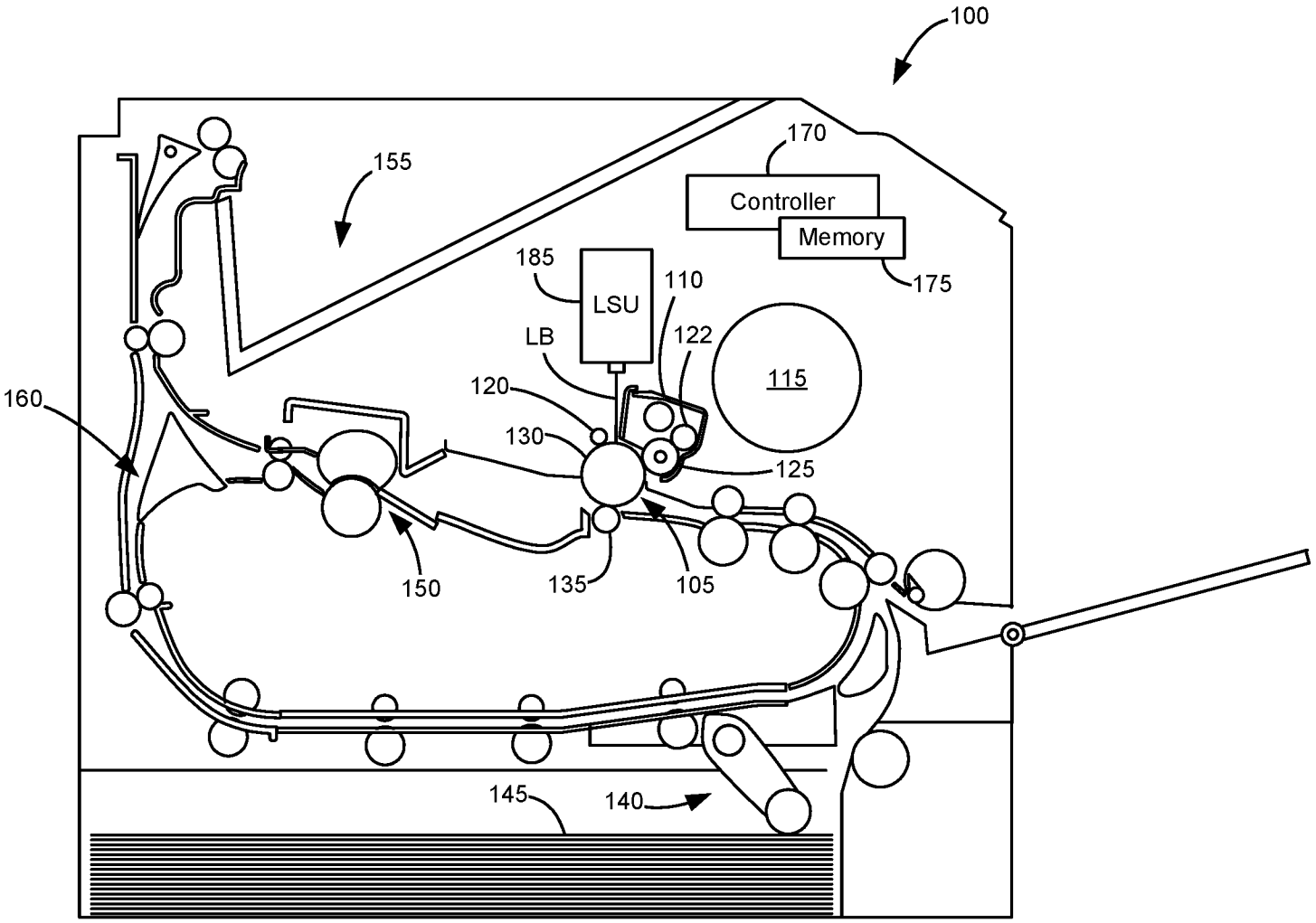
FIG. 1 is a schematic illustration of an image forming device according to one example embodiment.

FIG. 1 illustrates an electrophotographic image forming device 100 according to one example embodiment. Image forming device 100 includes an image forming station 105 having an imaging unit 110 that is operably connected to a toner reservoir or cartridge 115 for receiving toner for use in a printing operation. Toner cartridge 115 is controlled to supply toner as needed to imaging unit 110. Imaging unit 110 includes a toner sump for holding a supply of toner received from toner cartridge 115. One or more agitating members are typically positioned within the toner sump of imaging unit 110 for agitating and moving toner towards a toner adder roll 122 and a developer roll 125. A doctor blade (not shown) controls the level of toner on developer roll 125. Imaging unit 110 may also include a photoconductive (PC) drum 130 that receives toner from developer roll 125 during toner development to form a toned image on PC drum 130. PC drum 130 is paired with a transfer unit including a transfer roll 135 for use in transferring toner to a sheet of print media that is picked by a pick assembly 140 from a media stack 145 and fed through image forming station 105 between PC drum 130 and transfer roll 135. A fuser assembly 150 is disposed downstream of image forming station 105 and receives media sheets with the unfused toner images superposed thereon. In general terms, fuser assembly 150 applies heat and pressure to the media sheets in order to fuse toner thereto. After leaving fuser assembly 150, a media sheet is either deposited into output media area 155 or enters duplex media path 160 for transport to image forming station 105 for imaging on an opposite surface of the media sheet.

An image to be printed is typically electronically transmitted to a processor or controller 170 by an external device (not shown) or the image may be stored in a memory 175 embedded in or associated with the controller 170. Memory 175 may be any volatile and/or non-volatile memory such as, for example, random access memory (RAM), read only memory (ROM), flash memory and/or non-volatile RAM (NVRAM). Alternatively, memory may be in the form of a separate electronic memory (e.g., RAM, ROM, and/or NVRAM), a hard drive, a CD or DVD drive, or any memory device convenient for use with controller 170. Controller 170 may include one or more processors and/or other logic necessary to control the functions involved in electrophotographic imaging.

Image forming device 100 is depicted in FIG. 1 as a monochrome laser printer which utilizes only a single developer unit and PC drum 130 for depositing black toner to media sheets. In other alternative embodiments, image forming device 100 may be a color laser printer having four photoconductive members, each corresponding to an associated one of cyan, yellow, magenta, and black image planes, and one or more laser scanning units for outputting light beams toward corresponding photoconductive members to form latent images on each photoconductive member. Toner may be transferred to a media sheet in a single step process—from the plurality of photoconductive members directly to a media sheet. Alternatively, toner may be transferred from each photoconductive member onto an intermediate transfer member in a first step, and from the intermediate transfer member to a media sheet in a second step.

Figure 2:
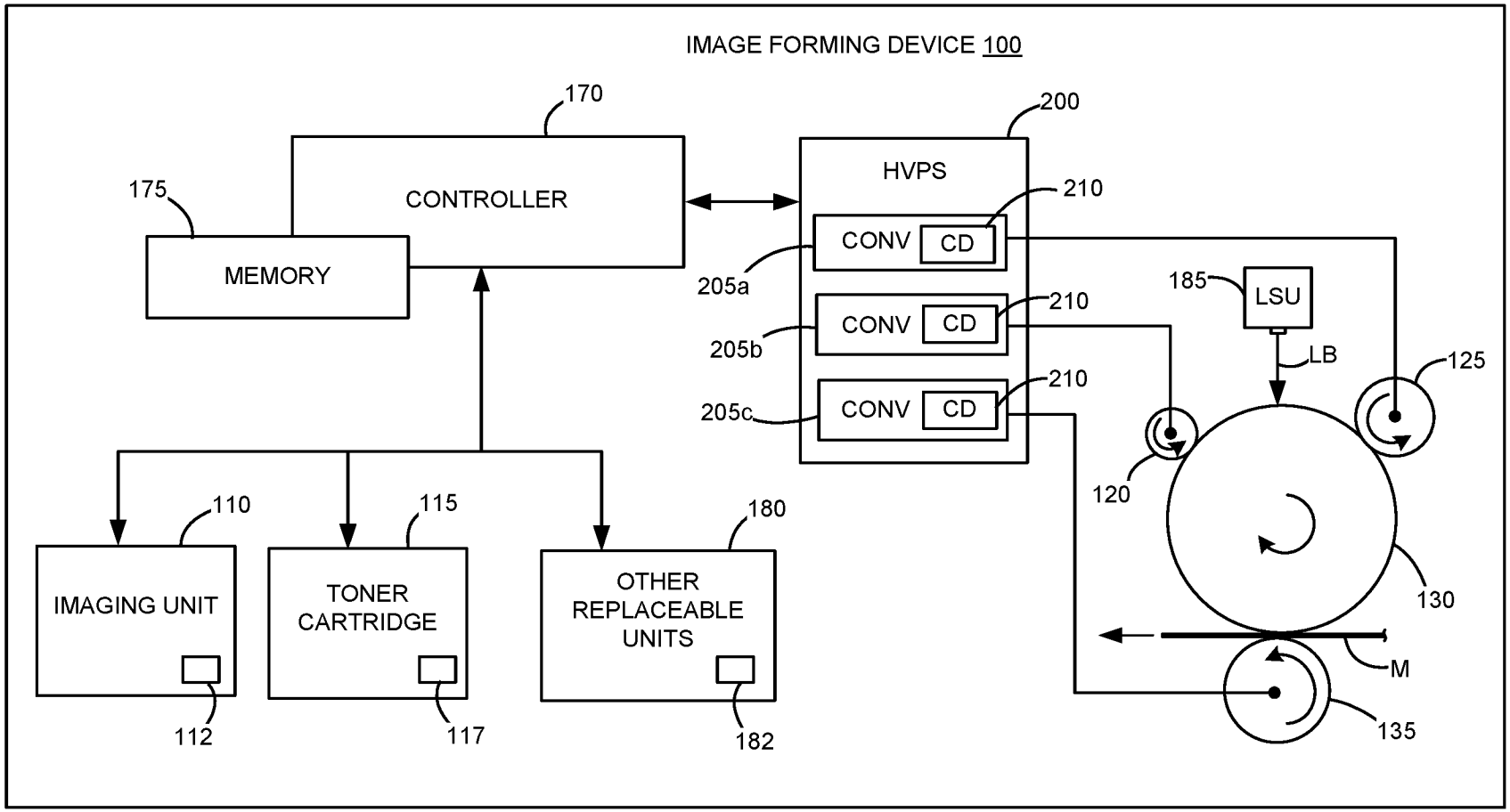
FIG. 2 is a block diagram of the image forming device including a high-voltage power supply (HVPS) according to one example embodiment.

With reference to FIG. 2, there is shown a block diagram depicting image forming device 100 including controller 170 communicatively coupled to various replaceable units such as imaging unit 110, toner cartridge 115, and other replaceable units/supply devices 180. Controller 170 communicates with respective processing circuitries or chips 112, 117, 182 on each of imaging unit 110, toner cartridge 115, and other supply devices 180. Each processing circuitry 112, 117, 182 may include a processor and associated memory such as RAM. ROM, and/or NVRAM and may provide authentication functions, safety and operational interlocks, operating parameters and usage information related to imaging unit 110, toner cartridge 115, and other supply devices 180, respectively. Image forming device 100 may also include one or more power supplies that provide power to different components of image forming device 100. In the example embodiment illustrated, image forming device 100 includes a high-voltage power supply (HVPS) 200 electrically connected to a charge roll 120, developer roll 125, and transfer roll 135 to provide electrical power thereto. Controller 170 is communicatively coupled to HVPS 200 to control the operation thereof, more particularly, to control the amount of voltage bias applied by HVPS 200 to each of charge roll 120, developer roll 125, and transfer roll 135 during image formation.

During image formation, charge roll 120 is electrified to a predetermined servo voltage bias by HVPS 200 such that charge roll 120 applies an electrical charge to the surface of PC drum 130. A laser beam LB from a laser scanning unit (LSU) 185 is directed to the surface of PC drum 130 and discharges those areas it contacts to form a latent image on the PC drum surface. Developer roll 125 (and hence, the toner thereon) is charged to a voltage bias level by HVPS 200 that is set between the voltage of the non-discharged areas of the surface of PC drum 130 and the discharged latent image. As a result of the imposed voltage bias differences, the toner carried by the developer roll 125 to PC drum 130 is attracted to the latent image and repelled from the remaining higher charged areas of PC drum 130. At this point in the image formation process, the latent image is said to be developed. HVPS 200 then applies voltage to transfer roll 135 opposite in polarity to the charge of toner material on PC drum 130 in order to move toner material from PC drum 130 to a media sheet M passing between PC drum 130 and transfer roll 135.

HVPS 200 may be characterized in such a way as to allow optimized print performance of image forming device 100 according to the methods described herein. Characterization of HVPS 200 may include setting parameters that define the manner in which HVPS 200 operates and supplies power to charge roll 120, developer roll, and transfer roll 135. In the example shown in FIG. 2, HVPS 200 includes a plurality of voltage converter blocks, namely a first voltage converter 205*a*, a second voltage converter 205*b*, and a third voltage converter 205*c*. First voltage converter 205*a* is connected to charge roll 120, second voltage converter 205*b* is connected to developer roll 125, and third voltage converter 205*c* is connected to transfer roll 135. In this example, voltage converters 205*a*, 205*b*, 205*c* are high-voltage converters that are used to step-up low voltage DC input signals to high voltage DC output levels for biasing charge roll 120, developer roll 125, and transfer roll 135, respectively. First, second, and third voltage converters 205*a*, 205*b*, 205*c* operate independently from each other to supply power to charge roll 120, developer roll 125, and transfer roll 135, respectively. First, second, and third voltage converters 205*a*, 205*b*, 205*c* may be generally similar in construction, with some variations therebetween depending on the desired output potential for use by a corresponding one of charge roll 120, developer roll 125, and transfer roll 135. For example, variations may include winding ratios of transformers determined by the desired output voltage range, and desired polarity of the outputs. For ease of description, any one of first, second, and third voltage converters 205*a*, 205*b*, 205*c* may be referred to as voltage converter 205 hereinafter.

In one example embodiment, each voltage converter 205 may be stored with characterization data CD in a corresponding memory unit 210. Characterization data CD may be stored in memory unit 210 during production and/or before HVPS 200 is installed in image forming device 100. Characterization data CD may include parameters defining a voltage response characteristic of voltage converter 205. For example, characterization data CD may define a slope and/or gain of voltage converter 205 which defines the level of output voltage provided by voltage converter 205 to a corresponding one of charge roll 120, developer roll 125, and transfer roll 135 based on control signals from controller 170. In this example, control signals may indicate an amount of voltage bias to be applied to charge roll 120, developer roll 125, or transfer roll 135. Control signals may be dependent on and/or associated with a print job request. For example, control signals provided to voltage converter 205 may be used to vary the amount of bias provided to charge roll 120, developer roll 125, or transfer roll 135 based on resolution, darkness level, media size and/or type, print speed, and other print settings and/or parameters associated with a print job.

Operating HVPS 200 may include a characterization procedure for voltage converter 205 that is performed during manufacture and/or production. During the characterization procedure, at least one setting is determined for each voltage converter 205 that achieves a particular voltage response characteristic which allows HVPS 200 to provide desired amounts of power to charge roll 120, developer roll, and transfer roll 135 for printing operations, and for image forming device 100 to have optimized print performance. For example, during production, HVPS 200 may be calibrated such that each voltage converter 205 may exhibit a corresponding predefined voltage response characteristic. The predefined voltage response characteristic is determined empirically based on circuit component values of HVPS 200 and by performing tests and measurements on several HVPSs of the same type or model.

Figure 3:
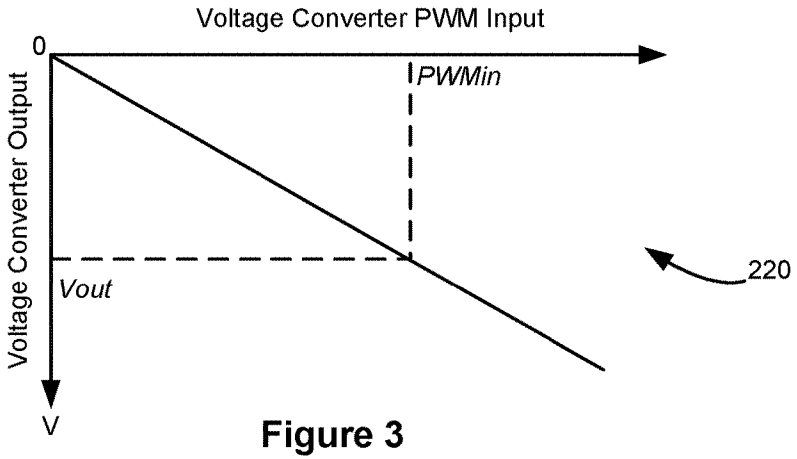
FIG. 3 illustrates a graph showing an empirically determined voltage response characteristic of a voltage converter of the HVPS according to one example embodiment.

FIG. 3 illustrates an example graph 220 showing an empirically determined voltage response characteristic which provides information on the output voltage performance of voltage converter 205 based on a pulse-width modulated (PWM) input. The PWM input may correspond to a value from 0 to 255 indicating control information associated with a print job request. Graph 220 is illustrated as a linear function having a slope that defines a gain describing the amount of change in output voltage as the PWM input changes. For example, given a requested darkness corresponding to a PWM input value of PWMin, an output level Vout is provided by voltage converter 205 according to the voltage response characteristic defined by graph 220. In example graph 220, the voltage output decreases as the PWM input increases at a rate defined by the slope of the linear function. It will be appreciated that the linear function is described only for purposes illustration and that other functions may be used to define the predefined voltage response characteristic of voltage converter 205.

The predefined voltage response may be different for each voltage converter 205 depending on the required output range for a corresponding one of charge roll 120, developer roll 125, or transfer roll 135. Accordingly, characterization data of each voltage converter 205 in HVPS 200 may differ from each other. For identical voltage converters found in different HVPSs belonging to a family of similar HVPSs of a same type (i.e., voltage converters used to provide bias to the same type of charge roll 120, developer roll 125 or transfer roll 135), the predefined voltage response characteristic is generally consistent from unit to unit which allows for the same linear function to be used for all voltage converters of the same type. Each voltage converter, however, is calibrated separately in order to determine converter-specific parameters that achieve its predefined voltage response characteristic. Individually calibrating each voltage converter may account for the existence of unit to unit variation due to accumulated tolerances of HVPS circuit components. Thus, while similar types of voltage converters are calibrated to have the same voltage response characteristic, their respective characterization data may vary such that characterization data of a voltage converter in one HVPS may differ from the characterization data of a similar voltage converter in another HVPS belonging to the same family of HVPSs of a same type.

In one example embodiment, image forming device 100 may selectively lock HVPS 200 based on a detected status and/or condition relating to an installed supply device, such as based on a determined authenticity of the installed supply device. As used herein, the term "lock" may refer to an action that makes HVPS 200 unable to perform its desired and/or intended function, such when performing print operations. For example, image forming device 100 may employ an electronic authentication scheme to authenticate consumable supply devices and/or replaceable units installed in image forming device 100. Controller 170 may send a verification challenge to a supply device and determine if the supply device correctly responds to the verification challenge. The authenticity may be verified by the controller 170 receiving from the supply device the correct response to the challenge. Otherwise, if the supply device does not respond correctly, the supply device may be detected as a clone or counterfeit indicating an error condition relating to the supply device. Appropriate actions may be taken to protect against the use of the unauthorized supply device in order to optimize performance of and/or prevent damage to image forming device 100.

In one example embodiment, HVPS 200 may be locked by intentionally altering the characterization of HVPS 200 if a counterfeit and/or unauthorized supply device is detected. In particular, characterization values associated with one or more of voltage converters 205 of HVPS 200 may be modified to change the voltage response characteristic of voltage converter 205. Characterization data CD of HVPS 200 may be altered to random or predetermined values so as to cause the voltage response of voltage converter 205 to deviate away from its predefined voltage response characteristic, as will be discussed in further detail below. Modifying the voltage response characteristic of voltage converter 205 may result in the deviation of the output of voltage converter 205 away from the desired voltage needed to bias a corresponding one of charge roll 120, developer roll, and transfer roll 135 when perform printing operations. Locking HVPS 200 by altering the predefined voltage response characteristic, for example, may cause print performance to become objectionable especially when the deviation is relatively large. By locking HVPS 200, a user may be encouraged to discontinue use of the unauthorized supply device in image forming device 100. To restore the predefined characterization settings and, thus, the predefined voltage response characteristic of voltage converter 205, the unauthorized supply device may be replaced with an authorized supply device. In this way, image forming device 100 may be protected against the use of unauthorized supply devices and/or prevent damage to image forming device 100.

Figure 4:
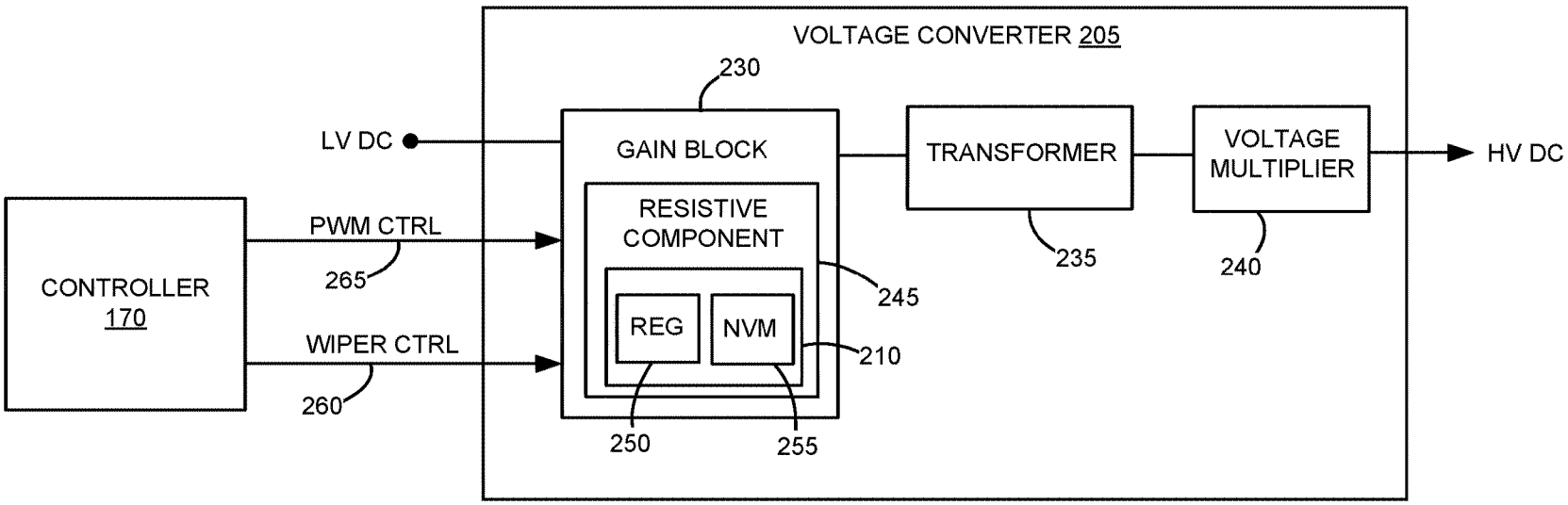
FIG. 4 is a block diagram of the voltage converter according to one example embodiment.

Referring to FIG. 4, an example block diagram of voltage converter 205 in communication with controller 170 is illustrated. Voltage converter 205 may be programmable and/or configurable by controller 170. In the example shown, voltage converter 205 includes a gain block 230, a transformer block 235, and a voltage multiplier circuit 240. Gain block 230, which may include a transistor network and/or one or more integrated circuits, has an input connected to a low-voltage (LV) DC source from a main power supply (not shown). Transformer block 235 may include a step-up transformer that steps-up the output of gain block 230 to high voltage DC output levels. Voltage multiplier circuit 240, which may include a doubler circuit, is shown connected to the output of transformer block 235 for increasing the voltage output of transformer block 235 and generate a high-voltage (HV) DC output for biasing a corresponding one of charge roll 120, developer roll 125, and transfer roll 135.

Gain block 230 is used to define the voltage response characteristic of voltage converter 205. Gain block 230 may have a variable gain and/or slope setting which may be controlled at least in part by the impedance or resistance of a resistive component 245. In this example, resistive component 245 includes a digitally programmable resistor which is used to set and adjust the gain/slope setting of voltage converter 205. Resistive component 245 may be adjustable over a wide enough resistance range to accommodate a full range of desired output values for voltage converter 205. In one example embodiment, resistive component 245 may include a 256-position digital rheostat in which the resolution allows for 256 wiper positions or steps. The wiper position sets the resistance value of resistive component 245 which in turn sets the slope/gain setting of gain block 230. The resistance value of the resistive component 245 may range from a few hundred ohms to a few hundred kilo-ohms. In this example, resistive component 245 may have a minimum resistance when its wiper position setting is set to zero and a maximum resistance when its wiper position setting is set to 255. In other examples, resistive component 245 may have any resolution and/or any number of wiper steps. In still other examples, resistive component 245 may include cascade, series, and/or parallel combination of digital rheostats that achieves a desired resolution.

Resistive component 245 may include memory unit 210 for storing wiper position values which form part of characterization data CD. Memory unit 210 is configured to allow multiple programming of the wiper position and for the wiper position to return to a default wiper position value on power-up. The default wiper position value may correspond to a resistance value that sets the voltage response of gain block 230 of voltage converter 205 to its predefined voltage response characteristic. The default wiper position value may be obtained during production of HVPS 200. For example, during production, the wiper position associated with resistive component 245 may be adjusted to change the resistance value of resistive component 245 until voltage converter 205 achieves its predefined voltage response characteristic. A test and/or debug system may be used to determine if the slope and/or other parameters of voltage converter 205 are within specification. As an example, the test and/or debug system may be used to provide a first PWM input (e.g., 0 PWM) and measure a corresponding first voltage converter output, and provide a second PWM input (e.g., 255 PWM) and measure a corresponding second voltage converter output. The actual slope may then be calculated based on the two inputs and two outputs. If the slope is within specification substantially corresponding to the predefined voltage response characteristic, the wiper position that achieves the desired slope may be stored in memory unit 210 as the default wiper position value.

In the example shown, memory unit 210 includes a register 250 and a non-volatile memory (NVM) 255. Register 250 is used for storing a wiper position value that sets the actual resistance value of resistive component 245. As an example, for an 8-bit resolution, register 250 may store one of 256 discrete positions (0-255) that defines a wiper position value which translates to a corresponding resistance value for resistive component 245. Accordingly, the wiper position stored in register 250 provides, at least in part, control of the voltage response of gain block 230. Register 250 is rewritable such that the wiper position value stored therein may be modified. NVM 255 is used for storing the default wiper position value which sets the wiper's power-on reset (POR) position. The wiper position stored in register 250 may return to the default wiper position value on HVPS power-up and/or when HVPS 200 is reset.

Controller 170 includes control logic that may be used to adjust the wiper position of resistive component 245 and manipulate the operation of voltage converter 205. In FIG. 4, controller 170 may adjust the wiper position setting of resistive component 245 by loading a wiper position value into register 250 via a wiper control line 260. The wiper position value stored in register 250 sets the resistance value of resistive component 245 which in turn defines the voltage response characteristic of voltage converter 205. Controller 170 may cause the adjustment of the wiper position setting of resistive component 245 when locking or unlocking HVPS 200. For example, controller 170 may cause the wiper position setting to change to a value different from the default wiper position value when locking HVPS 200, and cause the wiper position setting to change to the default wiper position value when unlocking HVPS 200.

Controller 170 also provides a PWM control signal via a PWM control line 265 that is used to control the output voltage of voltage converter 205. The operation of voltage converter 205 may be regulated by the frequency and/or duty cycle of the PWM control signal which may be accomplished by any known switching circuit such that voltage converter 205 produces an output voltage that varies as a function of the PWM control signal according to the voltage response characteristic of voltage converter 205. In this example, the PWM control signal from controller 170 may indicate an amount of voltage bias to be applied to charge roll 120, developer roll 125, or transfer roll 135. The PWM control signals may be dependent on and/or associated with a print job request, as previously described. With each voltage converter 205 of HVPS set to their respective predefined voltage response characteristics. PWM control signals from controller 170 may result in HVPS 200 providing the desired voltage bias to charge roll 120, developer roll 125, and transfer roll 135 to perform printing. On the other hand, if HVPS 200 has been locked, PWM control signals from controller 170 may result in HVPS 200 not providing the desired voltage bias to charge roll 120, developer roll 125, and transfer roll 135 which may cause objectionable print performance.

Figure 5:
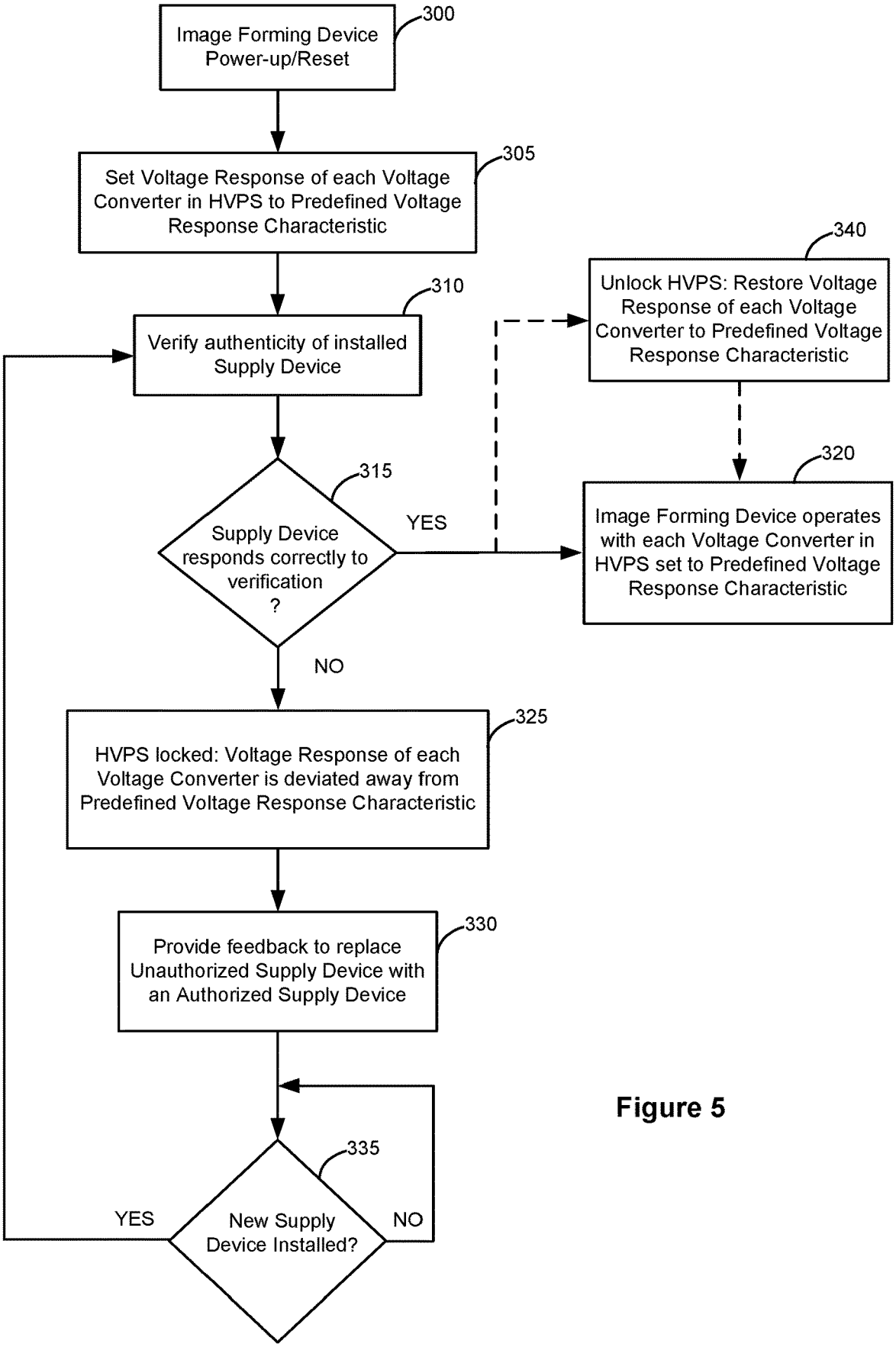
FIG. 5 is a flowchart illustrating a method of selectively locking the HVPS based on a detected status and/or condition of an installed supply device according to one example embodiment.

Referring now to FIG. 5, an example method for selectively locking HVPS 200 based on a detected status and/or condition of an installed supply device is illustrated. The detected status may be the result of a verification and/or authentication procedure performed on the installed supply device.

The start of the process is shown in block 300, wherein image forming device 100 has been reset. The default wiper position value of resistive component 245 of each voltage converter 205 may be retrieved from respective NVM 255 and stored in register 250, thereby setting the voltage response of each voltage converter 205 in HVPS 200 to the predefined voltage response characteristic at block 305.

At block 310, controller 170 may verify authenticity of the installed supply device by sending a verification challenge thereto. The verification challenge may be performed when the supply device has been reset, such as after installation or at an instance when power is first supplied to the supply device.

If, at block 315, controller 170 receives from the supply device the correct response to the verification challenge, then the supply device is identified as an authentic component. Image forming device 100 may then operate HVPS 200 with the voltage response of each voltage converter 205 set to its respective predefined voltage response characteristic at block 320.

If, at block 315, the supply device does respond correctly to the verification challenge, the supply device may be detected as a clone or counterfeit and appropriate actions may be taken to provide protection against unauthorized replacements and/or prevent damage to image forming device 100. At block 325, controller 170 may be configured to lock the print engine by locking HVPS 200. For example, controller 170 may be configured to cause HVPS 200 to modify the wiper position stored in register 250 of resistive component 245 so as to cause the voltage response of voltage converter 205 to deviate away from its predefined voltage response characteristic. The wiper position stored in register 250 may be changed to a random wiper position value or a predetermined wiper position value that is different and/or relatively remote from the default wiper position value. Controller 170 may modify the voltage response characteristic of one or more of voltage converters 205 to lock HVPS 200. Once locked, the voltage response of voltage converter 205 may no longer correspond to its predefined voltage response characteristic and HVPS 200 may not be able to perform its desired function. In one example, locking HVPS 200 may reduce the print performance of image forming device 100. The reduced print performance may serve as an indication to a user that the installed supply device is not compatible with and/or not authorized for use in image forming device 100. Feedback information may be provided to the user that the supply device is not an authorized component. To restore correct settings for HVPS 200 and restore normal operation of image forming device 100, feedback may be provided to replace the unauthorized supply device with an authorized supply device at block 330.

Image forming device 100 may monitor a new supply device installation at block 335. Upon image forming device 100 detecting installation of a new supply device following removal of the unauthorized supply device at block 335, controller 170 may verify authenticity of the newly installed supply device at block 310. At block 315, if the installed supply device does not respond correctly to the verification challenge, the newly installed supply device may be detected as a clone or counterfeit and HVPS 200 may remain locked at block 325. If, at block 315, controller 170 receives from the installed supply device the correct response to the verification challenge, then the installed supply device is identified as an authentic component. Controller 170 may then be configured to unlock the print engine by unlocking HVPS 200 at block 340. For example, controller 170 may be configured to cause HVPS 200 to restore the wiper position stored in register 250 of resistive component 245 of voltage converter 205 to the default wiper position value stored in NVM 255 so as to restore the voltage response of voltage converter 205 to its predefined voltage response characteristic. Once the default wiper position is restored, the voltage response of voltage converter 205 may correspond to the predefined voltage response characteristic and HVPS 200 may be able to perform its desired function which optimizes the print performance of image forming device 100. The optimized print performance may serve as an indication to the user that the newly installed supply device is compatible with and/or authorized for use in image forming device 100.

The configurations for controlling HVPS 200 based error conditions relating to installed supply devices are not limited to the example embodiments discussed above. Other configurations may be possible. For example, in alternative embodiments, controller 170 may initially lock HVPS 200 upon power-up of image forming device 100 such that the voltage response of voltage converter 205 is initially deviated away from the predefined voltage response characteristic during start-up. When an authorized supply device is installed in image forming device 100, controller 170 may unlock HVPS 200 such that the voltage response of voltage converter 205 is set to the predefined voltage response characteristic. Otherwise, HVPS 200 may remain locked until an authorized supply device is detected to be installed in image forming device 100.

The description of the details of the example embodiments have been described in the context of using voltage converters in an HVPS that supply power to print engine components such as the charge roll, developer roll, and transfer roll. However, it will be appreciated that the teachings and concepts provided herein may be applicable to other power supply components providing power to other system components and/or subassemblies of image forming device 100.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Apparent modifications include combining one or more features of various embodiments with features of other embodiments.

The invention claimed is:

1. A method of controlling a power supply in an image forming device, comprising:

detecting, by the image forming device, an error condition relating to a replaceable unit installed in the image forming device;

in response to detecting the error condition, altering a voltage response of a voltage converter of the power supply to deviate away from a predefined voltage response characteristic of the voltage converter;

determining, by the image forming device, whether the error condition has been corrected; and in response to determining that the error condition has been corrected, adjusting the voltage response of the voltage converter to correspond to the predefined voltage response characteristic, wherein the altering the voltage response includes adjusting a wiper setting of a 256-position digital rheostat of the voltage converter to a predetermined default wiper setting.

2. The method of claim 1, wherein the determining whether the error condition ha been corrected includes determining whether a valid replaceable unit has been installed in the image forming device following removal of the replaceable unit from the image forming device.

* * * * *